United States Patent [19]

Iijima et al.

[11] 4,370,208

[45] Jan. 25, 1983

[54] ELECTROLYTIC PROCESS OF AN AQUEOUS ALKALI METAL HALIDE SOLUTION AND ELECTROLYTIC CELL

[75] Inventors: Tokuzo Iijima, Kobe; Yasushi Samejima, Kakogawa; Kazuo Kishimoto, Takasago; Toshiji Kano; Kiyoshi Yamada, both of Kobe; Yoshio Hatta, Takasago, all of Japan

[73] Assignee: Kanegafuchi Kagaku Kogyo Kabushiki Kaisha, Osaka, Japan

[21] Appl. No.: 208,843

[22] Filed: Nov. 20, 1980

[30] Foreign Application Priority Data

Nov. 27, 1979 [JP] Japan ..... 54-153822

[51] Int. Cl.[3] ..... C25B 1/34; C25B 9/00

[52] U.S. Cl. ..... 204/98; 204/128; 204/263; 204/266

[58] Field of Search ..... 204/98, 128, 263, 266

[56] References Cited

U.S. PATENT DOCUMENTS 4,204,920 5/1980 Kurtz et al. ..... 204/128

4,242,184 12/1980 Ford ..... 204/128

*Primary Examiner*—R. L. Andrews

*Attorney, Agent, or Firm*—Armstrong, Nikaido, Marmelstein & Kubovcik

[57] ABSTRACT

An electrolytic process is provided for the electrolysis of an aqueous alkali metal halide solution, which comprises effecting the electrolysis in a cell being separated by a cation exchange membrane into an anode compartment and a cathode compartment, wherein washing liquid is supplied into a liquid seal pot provided at a cathode gas outlet of a cathode compartment and cathode gas evolved from the cell is contacted with the washing liquid in the liquid seal pot.

8 Claims, 3 Drawing Figures

FIG.1
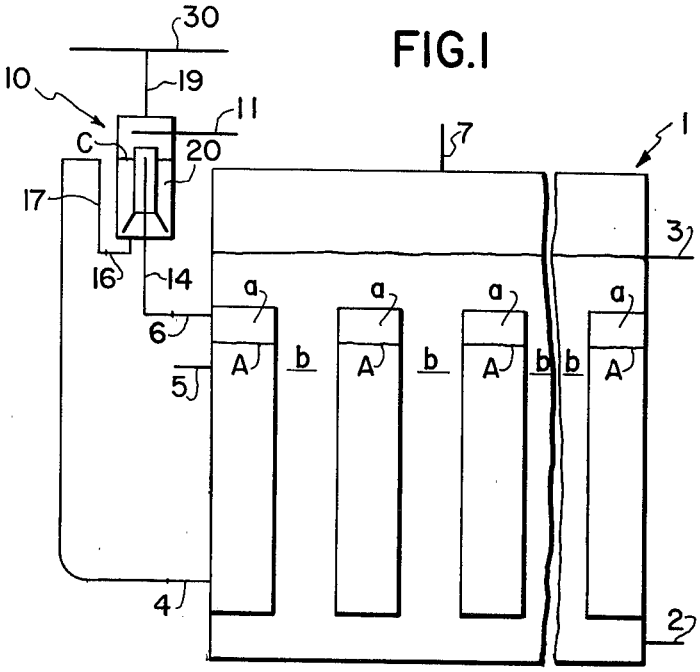
FIG.2
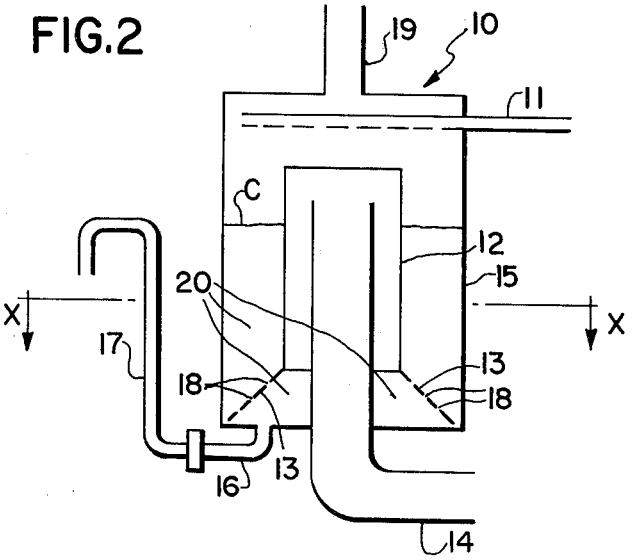
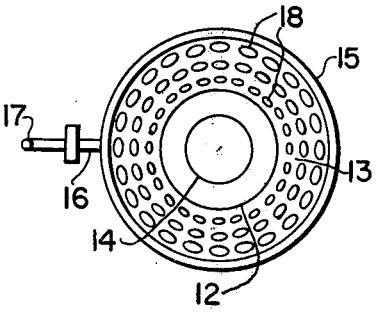
FIG.3

ELECTROLYTIC PROCESS OF AN AQUEOUS ALKALI METAL HALIDE SOLUTION AND ELECTROLYTIC CELL

SUMMARY OF THE INVENTION

An electrolytic process is provided for the electrolysis of an aqueous alkali metal halide solution, which comprises effecting the electrolysis in a cell being separated by a cation exchange membrane into an anode compartment and a cathode compartment, wherein washing liquid is supplied into a liquid seal pot provided at a cathode gas outlet of a cathode compartment and cathode gas evolved from the cell is contacted with the washing liquid of in the liquid seal pot.

Also disclosed is an electrolytic cell suitably for the above process which comprises a specifically fabricated liquid seal pot and an electrolytic cell which is partitioned by a cation exchange membrane into an anode compartment and a cathode compartment.

The invention not only enables recovery of cathode solution entrained by the cathode gas but enables decrease in cell voltage by elevating the temperature of the cell by sensible heat of the cathode gas.

DETAILED DESCRIPTION OF THE INVENTION

The present invention relates to an electrolytic process of an aqueous alkali metal halide solution and electrolytic cell used in the electrolytic process which comprises carrying out the electrolysis by recovering cathode solution (i.e., an aqueous alkali metal hydroxide liquor, the product) accompanied or entrained with cathode gas (i.e., hydrogen gas) evolved by the electrolysis at a cathode gas outlet, then recirculating the diluted aqueous alkali metal hydroxide liquor so recovered to a cathode compartment as an adding water. The present invention also recovers sensible heat of the cathode gas to thereby elevate temperature of the electrolytic cell, by which cell voltage is decreased. More specifically, it relates to a process for the electrolysis of an aqueous alkali metal halide solution and electrolytic cell used in such a process which comprises carrying out the electrolysis in a cell being partitioned by a cation exchange membrane into an anode compartment and a cathode compartment, while supplying washing liquid continuously or intermittently into a liquid seal pot positioned at a cathode gas outlet and contacting cathode gas evolved in the cell with the washing liquid in the liquid seal pot.

As a process for electrolysing an aqueous alkali metal halide solution (for example, sodium chloride solution), a mercury process and a diaphragm process employing asbestos diaphragm have been commercially put into practice.

Recently, a membrane process employing a cation exchange membrane has been proposed and is now being practiced in place of the above processes.

A conventional process, however, for producing an alkali metal hydroxide by the use of filter press type or finger type electrolytic cells employing a cation exchange membrane has a drawback that cathode solution or anode solution of the electrolytic cell is always accompanied or entrained with cathode gas or anode gas evolved. In particular, the cathode gas entrains the cathode solution, namely, an aqueous alkali metal hydroxide liquor; thereby leading to loss of the product (i.e., loss in current efficiency). Further, conventional processes are dreadfully disadvantageous from an industrially point of view, because recovery equipment has to be provided outside of the electrolytic system for recovering an aqueous alkali metal hydroxide liquor attended or entrained by the cathode gas evolved. Moreover, a great amount of an absorbing liquid (i.e., washing liquid of hydrogen gas) has to be recirculated to the recovery equipment.

A series of studies have been made by the present inventors concerning an electrolytic process of an aqueous alkali metal halide solution which is capable of recovery of cathode solution entrained by evolved cathode gas at a cathode gas outlet. It has been found that the above object can be achieved by the present invention and at the same time the above-mentioned drawbacks can be eliminated.

That is, the present invention provides a process for electrolysing an aqueous alkali metal halide solution, and electrolytic cell therefor which comprises effecting the electrolysis in a cell partitioned by a cation exchange membrane into an anode compartment and a cathode compartment while supplying washing liquid continuously or intermittently into a liquid seal pot positioned at a cathode gas outlet in the cathode compartment, and contacting evolved cathode gas with the washing liquid in the liquid seal pot. The feature of the present invention is that a specifically fabricated liquid seal pot is provided at a cathode gas outlet of an electrolytic cell (which is separated by a cation exchange membrane into an anode compartment and a cathode compartment) through which not only is an aqueous alkali metal hydroxide liquor entrained by the evolved cathode gas readily recovered at the cathode gas outlet (i.e., by the liquid seal pot), but also the recovered diluted aqueous alkali metal hydroxide liquor is reused for an adding water to the cathode compartment. Hence, the present invention eliminates the above-described defects of the conventional electrolytic cells including the loss of an aqueous alkali metal hydroxide liquor due to entrainment by the evolved cathode gas and the cost recovery equipment or recovery operation for collecting the aqueous alkali metal hydroxide liquor entrained by the cathode gas. It is also an outstanding and marked effect of the present invention that collection of an aqueous alkali metal hydroxide entrained by evolved cathode gas is readily effected at the cathode gas outlet (i.e., liquid seal pot) and the resulting collected diluted aqueous solution of an alkali metal hydroxide is reused for adding water to the cathode compartment.

Further, the present invention is markedly useful in that the aqueous alkali metal hydroxide liquor entrained by evolved cathode gas is collected in the liquid seal pot, thereby avoiding a drop in current efficiency. Also, the present invention controls the level of washing liquid in the liquid seal pot, so that the pressure in the cathode compartment is elevated so that mixing of air into the cathode compartment is prevented.

Moreover, the present invention has an advantage that because the washing liquid in the liquid seal pot is reused to add water to the cathode compartment, the washing liquid is heated with absorption of sensible heat of the evolved gas and the aqueous alkali metal hydroxide liquor entrained by the evolved gas is recycled back to the cathode compartment; the temperature of the electrolytic cell is thereby elevated and the electrolytic voltage is decreased.

Accordingly, in the present invention the washing liquid in the liquid seal pot is supplied through a gas-washing liquid inlet and is used partly or wholly as the adding water for the cathode compartment. For the washing liquid supplied into the liquid seal pot, water or an diluted aqueous solution of an alkali metal hydroxide can be used. Water is preferred because it enables effective recovery of the aqueous alkali metal hydroxide liquor entrained by evolved cathode gas. In this case it is preferred to shower or spray the washing liquid into the liquid seal pot, so that the cathode gas which has been washed while bubbling up through the washing liquid layer in the liquid seal pot is further brought into contact with the showery washing liquid, and thereby washed more effectively. The height of the seal and washing liquid in the liquid seal pot (i.e., the height of seal and washing liquid phase) is controlled in order to maintain the pressure of the cathode compartment at a desired pressure, according to the operational conditions, by the adjusting of the height of the percolation pipe from the gas-washed liquid outlet at the bottom of the liquid seal pot or by adjusting the angle of inclination of the percolation pipe at the fulcrum of the gas-washed liquid outlet.

The electrolytic cell used in the present invention is one which provides at a cathode gas outlet of an electrolytic cell, said electrolytic cell being partitioned by a cation exchange membrane into an anode compartment and a cathode compartment, a liquid seal pot comprising a gas supply pipe, a gas outlet, a cylindrical vessel, a cap-like cover, a gas-washing liquid inlet, a gas-washed liquid outlet and a percolation pipe, said gas outlet being located at the uppermost position of the cylindrical vessel, said gas supply pipe being located at the central portion of the bottom of the cylindrical vessel so as to pass through the bottom of the cylindrical vessel and to stretch up to an upper portion of the cylindrical vessel, said cap-like cover being positioned concentrically with the gas supply pipe so as the enclose the gas supply pipe and to have a certain space therebetween, said cap-like cover having a skirt in a shape of an umbrella expanding from the bottom of the cover to the outward circumference of the cylindrical vessel, said skirt having a plurality of holes that become larger from the inside to the outside circumference, said gas-washing liquid inlet being positioned at a space between the uppermost portion of the cylindrical vessel and the cap-like cover located so as to enclose the gas supply pipe, said gas-washed liquid outlet being positioned at the bottom of the cylindrical vessel and said percolation pipe being connected to the gas-washed liquid outlet.

The feature of the present invention is that an especially designed liquid seal pot is provided at the cathode gas outlet of the electrolytic cell which is partitioned by a cation exchange membrane into an anode compartment and a cathode compartment. For an electrolytic cell to which a liquid seal pot can be provided, there are included a conventional finger type cell and a filter press type cell, employing a cation exchange membrane as a separator. The term "finger type electrolytic cell" as used herein includes an electrolytic cell of flattened tube type construction as well as an electrolytic cell of finger type construction as described in J. S. Sconce, *CHLORINE-ITS MANUFACTURE, PROPERTIES AND USES,* Reinhold Publishing Corp., New York (1962), page 93. In more recent times, electrolytic cells of the flattened tube type construction are also generally referred to as finger type electrolytic cells. A filter press type electrolytic cell includes monopolar and bipolar cells.

In the electrolytic cell of the present invention, the percolation pipe of the liquid seal pot positioned at the cathode gas outlet is connected to the cathode solution inlet so that the seal and washing liquid in the liquid seal pot supplied through the gas-washing liquid inlet is partly or wholly fed to the cathode compartment as the adding water for the cathode compartment.

In said liquid seal pot used in the present electrolytic cell, an ordinary pipe suffices as the gas-washing liquid inlet but a spray is preferred. A spray causes the gas-washing liquid to disperse in a form of shower to result in more intimate contact with the cathode gas removed, thereby washing being effected more effectively. The percolation pipe is preferably positioned so as to be rotated right or left (i.e., so as to be inclined) at the fulcrum of the gas-washed liquid outlet of the liquid seal pot so that the pressure in the cathode compartment can be controlled, depending upon the operational conditions, by the adjusting the angle of inclination of the percolation pipe. In the aforesaid liquid seal pot a demister had better be provided at an upper portion to collect a mist of the washing liquid entrained by the cathode gas removed while bubbling up through the seal and washing liquid layer. Any known demister may be used including a netting type, a packing type and the like. As the demister material, there are included iron, stainless steel, plastics, ceramics and the like.

The electrolytic cell of the present invention employs a cation exchange membrane as a separator by which the electrolytic cell is separated into an anode compartment and a cathode compartment. Typical examples are cation exchange membranes conveying cation exchange groups such as perfluorosulfonic acids or sulfonic acid groups of which are partly or wholly substituted by carboxylic acid groups, and which are represented by "NAFION (registered trademark)" produced and sold by E. I. DuPont de Nemours & Co., in the United States. The perfluorosulfonic acid perfluorocarbon polymer membrane as used in the examples described below has the following structure:

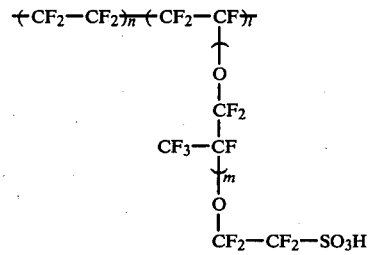

The concentration of ion exchange sites can be indicated by the weight of dry resin per equivalent of $SO_3^-$ ion exchange site, and is usually from about 1,100 to 1,500 g per equivalent of $SO_3^-$ ion exchange site.

As the material of the cap-like cover (including a skirt) located at the liquid seal pot of the present electrolytic cell, there are included, for example, metals such as iron and stainless steel, these metals lined with rubber materials, and corrosion resistant plastics such as FRP, CPVC and the like. The holes are provided radially on the skirt in such a way that they become larger from the inside circumference to the outside, and through which the cathode gas bubbles up uniformly through the seal and washing liquid layer to result in effective washing.

The electrolytic cell of the present invention is suitably employed for the electrolysis of an aqueous alkali metal halide solution, examples of which are sodium chloride, potassium chloride and the like. An aqueous solution thereof is supplied into the anode compartment as the anode solution. On the other hand, as the cathode solution, the cathode gas washing liquid (i.e. seal and washing liquid) supplied into the liquid seal pot is introduced partially or wholly into the cathode compartment as mentioned earlier.

Hereinafter, an embodiment of an electrolytic process of an aqueous alkali metal halide solution and an electrolytic cell used in the process will be explained by way of drawings.

FIG. 1 is a partial longitudinal sectional view illustrating an embodiment of an electrolytic cell used in the present invention.

FIG. 2 depicts a longitudinal sectional view showing an embodiment of a liquid seal pot located in the electrolytic cell of the present invention.

FIG. 3 is a horizontal sectional view taken along a line (X)—(X) of FIG. 2.

Referring to FIG. 1, the numeral (1) is an electrolytic cell (finger type electrolytic cell), (a) is a cathode compartment separated from an anode compartment (b) by a cation exchange membrane (not shown) positioned along the inside circumferential surface of upper and lower membrane supports and along the vertical inside circumferential surface of a flat cylindrical cathode, (b) is an anode compartment surrounded by the flat cylindrical cathode through which an anode is interposed and is separated from the cathode compartment (a) by the cation exchange membrane. As the anode, an expandable metallic anode such as an expandable DSE manufactured by Permelec Electrode Ltd., (for example, an anode made of titanium coated with ruthenium oxide) and the like are preferably employed. The numeral (2) is anode solution (e.g., an aqueous alkali metal chloride solution) inlet, (3) is anode solution (i.e., depleted brine) outlet, (4) is cathode solution inlet, (5) is cathode solution (i.e., an aqueous alkali metal hydroxide liquor, the product) outlet, (6) is cathode gas (i.e., hydrogen gas) outlet, (7) is anode gas (i.e., chlorine gas) outlet. The numeral (10) is a liquid seal pot connected to the cathode gas outlet (6), (11) is gas-washing liquid inlet, (16) is cathode gas-washed liquid outlet, (17) is a percolation pipe connected to the gas-washed liquid removal outlet (16) and connected to the cathode solution inlet (4). The numeral (19) is washed cathode gas outlet connected to cathode gas main pipe (30).

At first, the anode solution is introduced through the anode solution inlet (2) into the anode compartment (b), where it is electrolysed to produce chlorine gas and alkali metal ions. The alkali metal ions pass through the cation exchange membrane to the cathode compartment, then they are dissolved in the cathode solution. The electrolysed anode solution (i.e., depleted brine) and evolved chlorine gas ascend to reach an upper portion of the anode compartment (b) and they both are separated from each other at the anode solution level (13). Thereafter the depleted brine is removed through the anode solution outlet (3) and chlorine gas is removed through the anode gas outlet (7). On the other side, the cathode solution is fed though the cathode solution inlet (4) into the cathode compartment (a) where it dissolves alkali metal ions which are generated as the result of electrolysis in the anode compartment (b) and permeated through the cation exchange membrane to the cathode compartment and an aqueous alkali metal-hydroxide liquor is produced, which is then removed through the cathode solution outlet (5). On that occasion, the cathode gas evolved in the cathode compartment (a) goes upwardly to an upper portion of the cathode compartment and is separated from the cathode solution at the cathode solution level (A) (the gas-liquid separation is not perfectly carried out and hence the aqueous alkali metal hydroxide solution, i.e., cathode solution entrains hydrogen gas). The cathode gas is removed through the cathode gas outlet (6), then introduced through the gas supply pipe (14) into the liquid seal pot (10) where it is washed with the seal and washing liquid (20), then removed through the washed cathode gas outlet (19) to the cathode gas main pipe (30).

In such a case, for the cathode solution supplied through the cathode solution inlet (4) into the cathode compartment, the seal and washing liquid (20) fed through the cathode gas washing liquid inlet (11) is employed partially or wholly, and is supplied into the cathode compartment (a) through the cathode solution inlet (4) via the percolation pipe (17) connected to the gas-washed liquid outlet (16).

Referring to FIG. 2 and FIG. 3, the numeral (10) is the liquid seal pot, (11) is the gas-washing liquid inlet, (12) is the cap-like cover, (13) is the skirt of the cap-like cover (12), (14) is the gas supply pipe, (15) is the cylindrical vessel, (16) is the gas-washed-liquid outlet, (17) is the percolation pipe, (18) is holes provided on the skirt (13), (19) is the washed cathode gas outlet and (20) is the seal and washing liquid.

First of all, the gas-washing liquid (i.e., water or a diluted solution of an alkali metal hydroxide, which is used as adding water for the cathode compartment) is introduced through the gas-washing liquid inlet (11) into the liquid seal pot (10) to form a liquid layer of the seal and washing liquid (20) according to the height of the liquid of the percolation pipe (17), and then supplied to the cathode compartment through the cathode solution inlet (numbered as (4) in FIG. 1) via gas-washed liquid outlet (16) and the percolation pipe. Cathode gas evolved in the cathode compartment is fed through the gas supply pipe (14) into the liquid seal pot (10) and passes, while bubbling, through the liquid layer of the seal and washing liquid (20) formed between the gas supply pipe (14) and the cap-like cover (12) and between the cap-like cover (12) and the side wall of the cylindrical vessel (15) via holes (18) provided on the skirt (13) of the cap-like cover (12). During the passage, the cathode solution entrained by the cathode gas is washed and the washed cathode gas is then removed through the washed cathode gas outlet (19) to the cathode gas main pipe (numbered as (30) in FIG. 1).

The level (C) of the seal and washing liquid (20) in the liquid seal pot is controlled by the rotation of the percolation pipe right or left at the fulcrum of the gas-washed liquid outlet (16) (i.e., by the inclination of the percolation pipe), by which the pressure in the cathode compartment is adjusted dependent upon the operational conditions.

As was described in detail above, the present invention is capable of not only collecting the cathode solution entrained by the cathode gas at the cathode gas outlet, but also, the seal and washing liquid containing the so collected cathode solution i.e., aqueous alkali metal hydroxide liquor is used as adding water for the cathode compartment. In addition, the present invention is also capable of elevating the temperature of the electrolytic cell by the recovery of sensible heat of the cathode gas, thereby reducing the cell voltage. For the reasons, the present invention is exceedingly useful in industry.

Hereinafter, the present invention will be explained in more detail by way of examples which are only illustrative of the invention, and the present invention is not limited thereto.

EXAMPLE 1

Using an electrolytic cell providing a liquid seal pot as illustrated in FIG. 1, an aqueous solution of sodium chloride was electrolysed. The electrolytic cell (1) is a monopolar finger type electrolytic cell which comprises dimensionally stable anodes, 700 mm long and 600 mm wide, iron mesh cathodes provided at a cathode box which were positioned so as to enclose the anodes, and a cell cover made of F.R.P. As a cation exchange membrane "NAFION 315" manufactured by E. I. Du-Pont de Nemours & Co. was employed. The membrane was formed in a flat cylindrical shape and then secured to upper and lower membrane supports whereby the electrolytic cell was separated into the anode compartment (b) and the cathode compartment (a).

The liquid seal pot (10) comprises a cylindrical vessel having 100 mm diameter and 300 mm height, and a cap-like cover (12) made of iron and having a cylindrical portion with 40 mm diameter and 200 mm height and a skirt (13) having the inside circumference of 40 mm diameter, the outside circumference of 80 mm diameter and 45 mm distance between the inside and outside circumferences.

As electrolysing conditions, an aqueous solution of sodium chloride was fed into the anode compartment (b) to be 2 N in the NaCl concentration, cathode gas washing liquid was added continuously to the cathode compartment (a) via liquid seal pot (10) to maintain 20% concentration of sodium hydroxide and electric current was supplied to be 23.5 A per $dm^2$ in current density of the anode.

The temperature of the electrolytic cell was maintained at 89° C. and the cell voltage was 3.20 V. The temperature of the cathode gas was 50° to 55° C. and 3 g per liter of sodium hydroxide was contained in a drain entrained by the cathode gas discharged through the washed cathode gas outlet (19) to the cathode gas main pipe (30). Air was prevented perfectly from mixing into the cathode compartment.

COMPARATIVE EXAMPLE 1

A comparative experiment was carried out in a similar manner to that of Example 1, except that an electrolytic cell with no liquid seal pot was used.

The temperature of the electrolytic cell was 80° C. and the cell voltage was 3.35 V. The temperature of cathode gas was 78° C. and the content of sodium hydroxide in a drain entrained by the cathode gas was 48 g per liter.

What we claim is:

1. A process for the electrolysis of an aqueous alkali metal halide solution in a cell partitioned by a cation exchange membrane into an anode compartment and a cathode compartment, which comprises supplying washing liquid continuously or intermittently into a liquid seal pot, passing cathode gas evolved from said cell into said liquid seal pot and, contacting said evolved cathode gas washing with said washing liquid in said liquid seal pot and using said washing liquid in said liquid seal pot partly or wholly as adding water for the cathode compartment.

2. The process of claim 1, wherein the washing liquid supplied into the liquid seal pot is water.

3. The process of claim 1, wherein the height of the surface of the washing liquid in the liquid seal pot is controlled.

4. The process of claim 1, wherein the washing liquid is sprayed from an upper portion of the liquid seal pot.

5. An electrolytic cell for the electrolysis of an aqueous alkali metal halide solution which provides a liquid seal pot at a cathode gas outlet of an electrolytic cell, said electrolytic cell being partitioned by a cation exchange membrane into an anode compartment and a cathode compartment, said liquid seal pot comprising a gas supply pipe, a gas outlet, a cylindrical vessel, a cap-like cover, a gas-washing liquid inlet, a gas-washed liquid outlet and a percolation pipe, said gas outlet being located at the uppermost portion of the cylindrical vessel, said gas supply pipe being connected to said cathode gas outlet and having an opening located at the central portion of the bottom of the cylindrical vessel which passes through the bottom of the cylindrical vessel into an upper portion of the cylindrical vessel, said cap-like cover being positioned concentrically with the gas supply pipe and having a top and an upper cylindrical portion which are positioned a certain distance from the gas supply pipe and enclose the gas supply pipe, said cap-like cover having a skirt portion expanding from the bottom of the upper cylindrical portion of the cover toward the outward circumference of the cylindrical vessel, said skirt being provided with a plurality of holes which become larger from the inside to the outside circumference, said gas-washing liquid inlet being positioned at a space between the uppermost portion of the cylindrical vessel and the cap-like cover, said gas-washed liquid outlet being positioned at the bottom of the cylindrical vessel and said percolation pipe being connected to the gas-washed liquid outlet.

6. The electrolytic cell of claim 6, wherein the gas-washing liquid inlet includes a spray means.

7. The electrolytic cell of claim 6, wherein the percolation pipe, and gas-washed liquid outlet are connected by fulcrum means and an angle of inclination of the percolation pipe is variable at the said fulcrum means.

8. The electrolytic cell of claim 6, wherein a demister is positioned at an upper portion of the gas-washing liquid inlet.

* * * * *